US010726819B1

(12) United States Patent
Hamilton

(10) Patent No.: US 10,726,819 B1
(45) Date of Patent: Jul. 28, 2020

(54) HEEL RAISED ADJUSTABLE DRUM PEDAL

(71) Applicant: Christopher David Hamilton, Fort Worth, TX (US)

(72) Inventor: Christopher David Hamilton, Fort Worth, TX (US)

( * ) Notice: Subject to any disclaimer, the term of this patent is extended or adjusted under 35 U.S.C. 154(b) by 0 days.

(21) Appl. No.: 16/431,736

(22) Filed: Jun. 5, 2019

(51) Int. Cl.
*G10D 13/11* (2020.01)

(52) U.S. Cl.
CPC ..... *G10D 13/11* (2020.02)

(58) Field of Classification Search
CPC ..... G10D 13/006
See application file for complete search history.

(56) References Cited

U.S. PATENT DOCUMENTS 5,458,039 A * 10/1995 Ashby ..... G10D 13/006 84/422.1
9,162,106 B1 * 10/2015 Scheiman ..... A63B 23/08

* cited by examiner

*Primary Examiner* — Kimberly R Lockett
(74) *Attorney, Agent, or Firm* — SMU Law School Patent Clinic

(57) ABSTRACT

A drum pedal where the heel of the drum pedal is higher than the entire drum pedal board. The drum pedal is adjustable and ergonomic giving the user better control and leverage through modifications made to the drum pedal board and heel of the pedal.

4 Claims, 6 Drawing Sheets

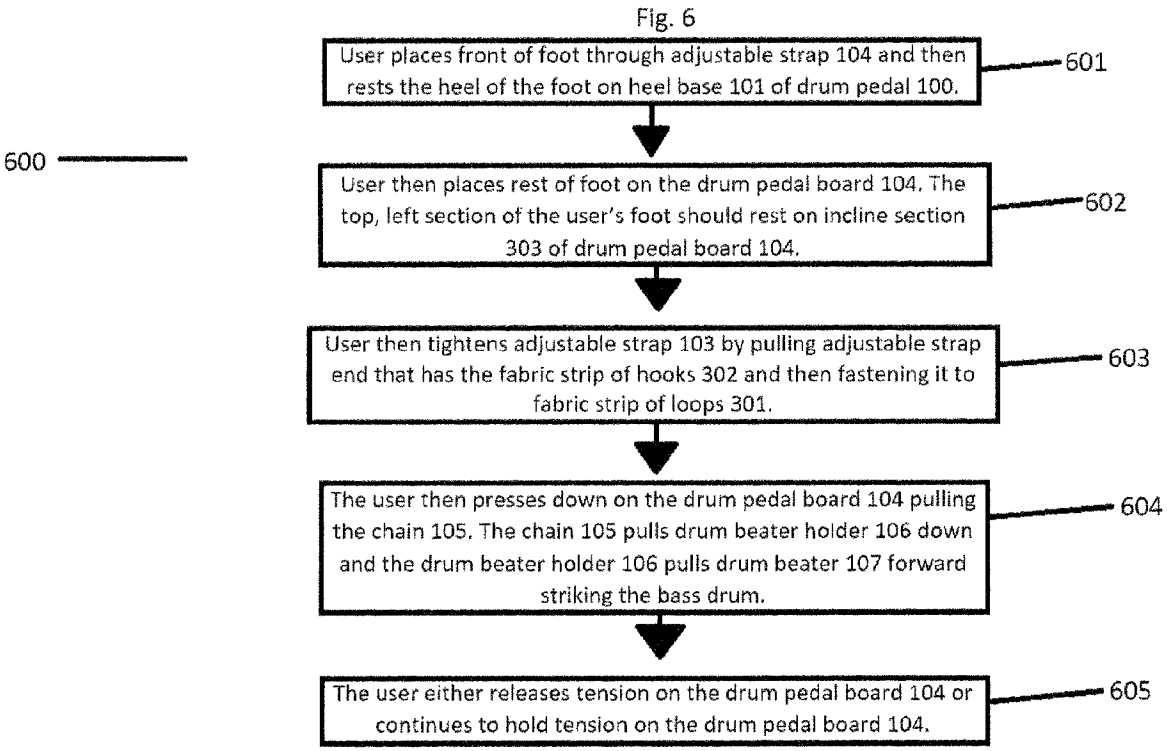
Fig. 6
600
601
User places front of foot through adjustable strap 104 and then rests the heel of the foot on heel base 101 of drum pedal 100.
602
User then places rest of foot on the drum pedal board 104. The top, left section of the user's foot should rest on incline section 303 of drum pedal board 104.
603
User then tightens adjustable strap 103 by pulling adjustable strap end that has the fabric strip of hooks 302 and then fastening it to fabric strip of loops 301.
604
The user then presses down on the drum pedal board 104 pulling the chain 105. The chain 105 pulls drum beater holder 106 down and the drum beater holder 106 pulls drum beater 107 forward striking the bass drum.
605
The user either releases tension on the drum pedal board 104 or continues to hold tension on the drum pedal board 104.

HEEL RAISED ADJUSTABLE DRUM PEDAL

BACKGROUND OF THE INVENTION

1. Field of the Invention

The present invention is in the field of musical equipment and accessories and pertains particularly to drum pedals.

2. Description of Related Art

In the art of drumming, more particularly playing a drum set, many types of drum pedals have been developed that are used by the foot to strike the bass drum. Bass drum pedals include a single pedal and double pedals for both feet.

One problem is that drum pedals can be awkward to use causing rapid fatigue of muscles involved and mistaken timing of strikes. Many drum pedals fatigue the tibia and foot muscles because of the angle of the foot as it moves to push the drum pedal board.

Most pedals also have a heel on the drum pedal that sits lower than the top of the drum pedal board. Many drummers will hold their heel up and off the drum pedal to get better leverage and movement but have to use muscles to stabilize the heel as there is no support at that height.

Another problem is the drum pedal can be hard to control as the speed of the strikes increase. Rebound and feel of the drum pedal are used more to control the strikes as strikes increase. Many drum pedals have a flat drum pedal board that is not ergonomic to the user.

Therefore, what is clearly needed is a drum pedal that is ergonomic and solves the problems that are mentioned above.

BRIEF SUMMARY OF THE INVENTION

In one embodiment of the invention a drum pedal mimicking natural human movement with a raised heel and lowered pedal board is provided, compromising a heel that is higher than a drum pedal board and can be adjusted in height with heel plates, a drum pedal board that is at a slight decline and has an adjustable strap, and a drum pedal board has an inclined section with gripping surface at the top left portion of the drum pedal board for better control, a drum pedal has a raised heel and lowered drum pedal board that mimic the natural movement of the ankle and foot when walking, as the weight moves through the ball of the foot to the toes, the heel is raised above the rest of the foot, and at the top of the drum pedal board is a chain that connects the drum pedal board to a drum beater holder, the drum beater holds a drum beater, and as a heel of a foot sits on the heel of the drum pedal and as the rest of the foot presses down on the drum pedal board the chain is pulled down which pulls the drum beater holder down which pulls the drum beater forward.

In one embodiment the heel plates can be added to the heel base, the height of a drum pedal heel can be raised or lowered using heel plates; the heel base can't be adjusted, only added to, heel plates have inserts on the bottom that fit into crevasses on the top of a heel base and other heel plates, heel plates should be made out of any suitable or desired material.

In one embodiment the pedal board is at a slight decline between 2 and 5 degrees and below the heel at resting state, the raised heel and lowered pedal board give a more natural movement to how the foot and ankle work when using the drum pedal.

In one embodiment the pedal board has an adjustable strap attached that a foot fits through and the adjustable strap can be tightened or loosened on the foot, the adjustable strap is tightened using a hook and loop type fastening system, the strap width should cover part of the top of the foot over the arch.

Also, in one embodiment the drum pedal board has a section at the top, left that is at a slight incline and has a gripping surface suitable for better control.

BRIEF DESCRIPTION OF THE SEVERAL VIEWS OF THE DRAWINGS

FIG. 6 is a process flow chart illustrating the use of the drum pedal FIG. 1.

DETAILED DESCRIPTION OF THE INVENTION

The inventor provides a unique and adjustable drum pedal giving the user more stability and efficiency of his movement. The new drum pedal raises the heel of the drum pedal above the drum pedal board. The present invention is described in enabling detail in the following examples, which may represent more than one embodiment of the present invention.

Figure 1:
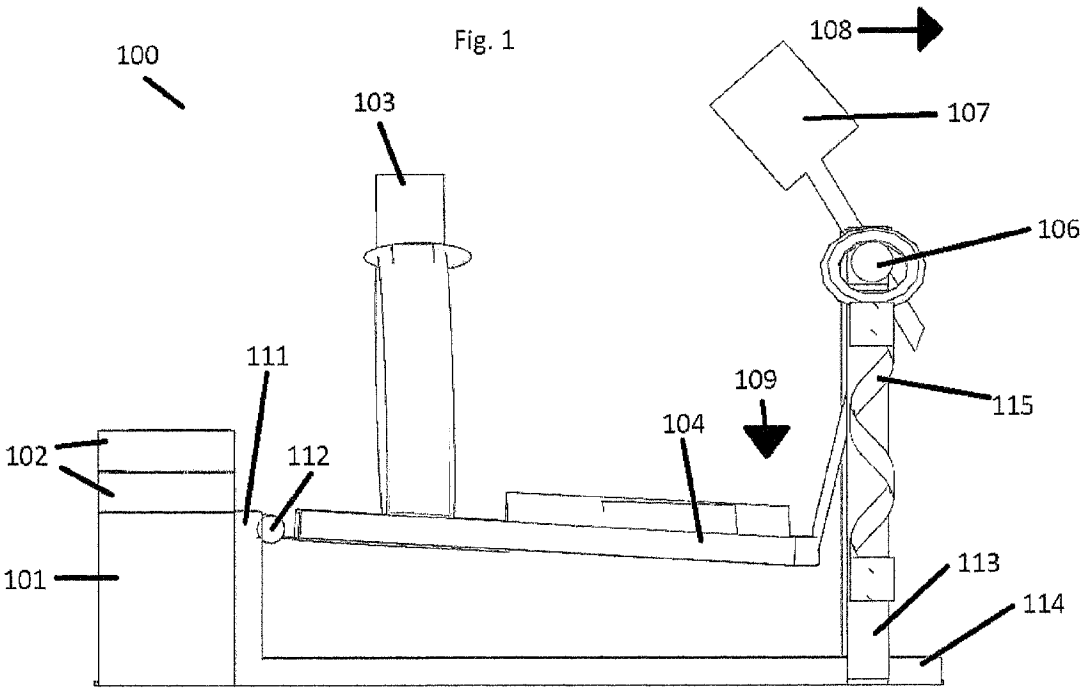
FIG. 1 is a side view of the drum pedal according to an embodiment of the present invention.

FIG. 1 is a side view of a drum pedal 100 according to an embodiment of the present invention. A heel base 101 is on the left side of a drum pedal 100 is connected to a heel plate 102 which can be added or removed to add or reduce the height of the heel of drum pedal 100 in this embodiment. Heel base 101 cannot be adjusted in height in an embodiment of the present invention. Heel base 101 only allows heel plates 102 to be added to heel base 101 in an embodiment of the present invention.

A drum pedal board 104 is directly in front of, and slightly lower than heel base 101 in this embodiment of the present invention. The drum pedal board 104 sits at a slight decline in its resting state and has an adjustable strap 103 where the arch of the foot sits on the drum pedal board in this embodiment. Drum pedal board 104 is connected to a hinge 112 in this embodiment. Hinge 112 runs the width of drum pedal board 104 and is connected to a vertical wall 111 in this embodiment. Vertical wall 111 is connected to a drum pedal base 114 and runs the width of drum pedal board 104 in an embodiment of the present invention.

When the drummer's foot presses down on drum pedal board 104, drum pedal board 104 moves downward, as shown in 109, against a spring 115 that provides tension, pulling a chain 105 that is connected to a drum beater holder 106 in this embodiment of the present invention. Drum beater holder 106 then moves down causing it to pull and move a drum beater 107 forward and strike the bass drum, as shown in movement 108, in an embodiment of the present invention. Drum beater holder 106 is being held up by 2 columns 113 that are connected to a drum base 114 in an embodiment of the present invention.

Figure 2:
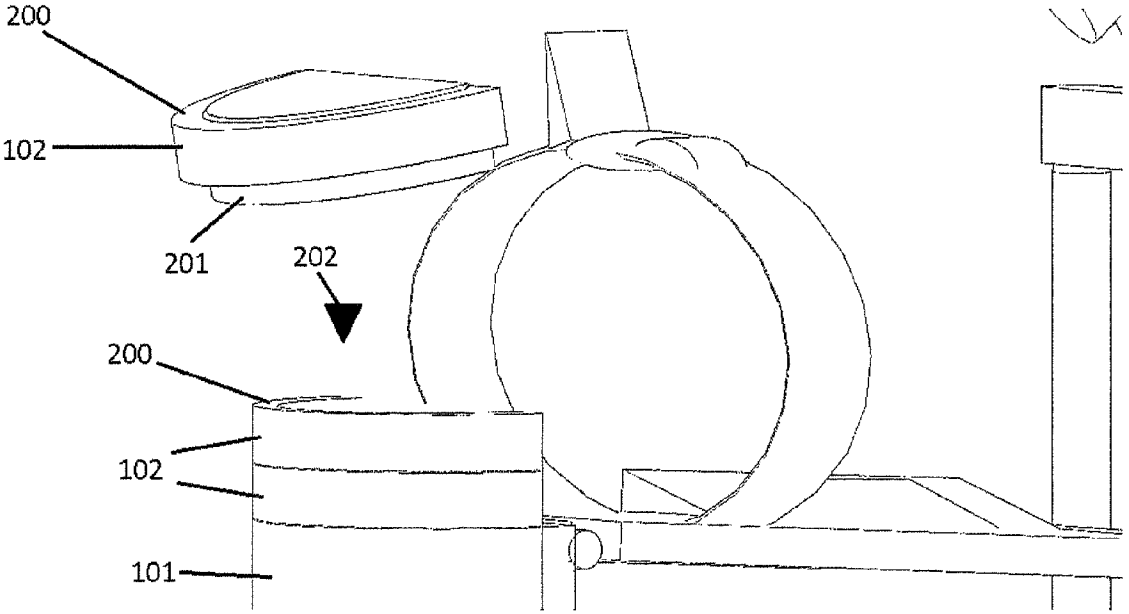
FIG. 2 is an elevation view of a heel section of FIG. 1 according to an embodiment of the present invention.

FIG. 2 is an elevation view of a heel section of FIG. 1 according to an embodiment of this present invention. FIG. 2 is demonstrating how a raised heel of drum pedal 100 works in this embodiment of the present invention. FIG. 2 contains various components from FIG. 1. The heel of the drum pedal 100 is made up of heel base 101 and heel plates 102 as introduced in FIG. 1. Heel base 101 and heel plates 102 have a thin crevasse 200 at the back of the heel that allows a heel insert 201 to fit into thin crevasse 200 as demonstrated in the movement of 202 in this embodiment of the present invention. Only heel plates 102 have a heel insert 201 in this embodiment. A user can raise or lower the heel of the drum pedal 100 to a desirable or suitable height in an embodiment of the present invention.

Figure 3:
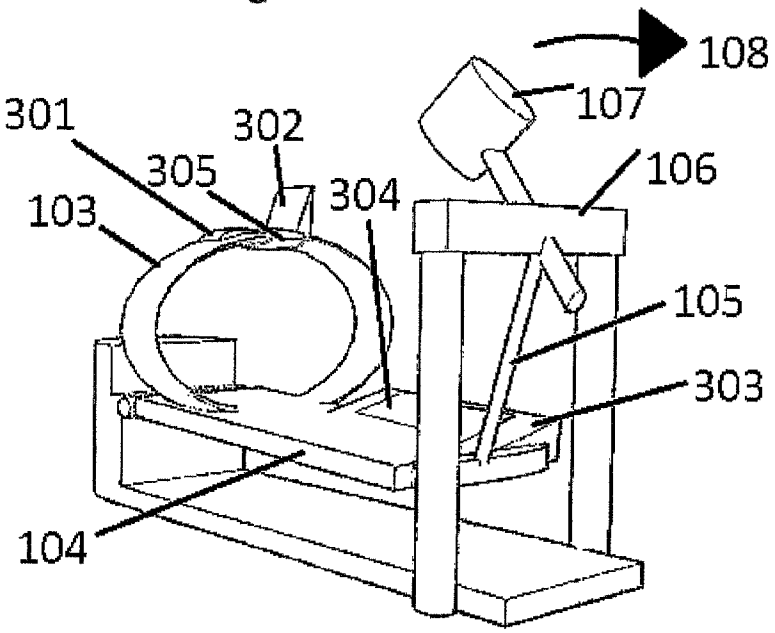
FIG. 3 is a front view of FIG. 1 according to a further embodiment of the present invention.

FIG. 3 is a front view of FIG. 1 according to a further embodiment of the present invention. FIG. 3 shows drum pedal board 104 that was introduced in FIG. 1 from a front view in an embodiment of the present invention. FIG. 3 contains various components introduced in FIG. 1 in an embodiment of the present invention. Drum pedal board 104 is on a slight decline in this embodiment. Adjustable strap 103 operates as a hook and loop fastening system in an embodiment of the present invention. Adjustable strap 103 can be tightened by pulling strap with a fabric strip of hooks 302 through a buckle 305 and then fastening fabric strip of hooks 302 onto a fabric strip of loops 301 section of the adjustable strap 103 in an embodiment of the present invention. Adjustable strap 103 can be loosened by unfastening fabric strip of hooks 302 from fabric strip of loops 301 and pulling bottom strap, containing fabric strip of loops 301, away from buckle 305 causing top strap, containing fabric strip of hooks 302, to loosen in an embodiment of the present invention. The top left side of drum pedal board 104 has a slight incline section 303 in an embodiment of the present invention. Incline section 303 also has a section that has a gripping surface 304 on the top of it in an embodiment of the present invention. This helps the user's foot stay on drum pedal board 104 and more control in an embodiment of the present invention. Drum pedal board 104 is pushed down pulling connected chain 105 in this embodiment. Chain 105 is connected at the middle of the top of drum pedal board 104 and connected to the middle, front of drum beater holder 106 in this embodiment. When drum pedal board 104 is pushed down, it pulls chain 105 and chain 105 pulls drum beater holder 106 down causing drum beater 107 to be pulled forward, as demonstrated in movement 108 in FIG. 1, in an embodiment of the present invention.

Figure 4:
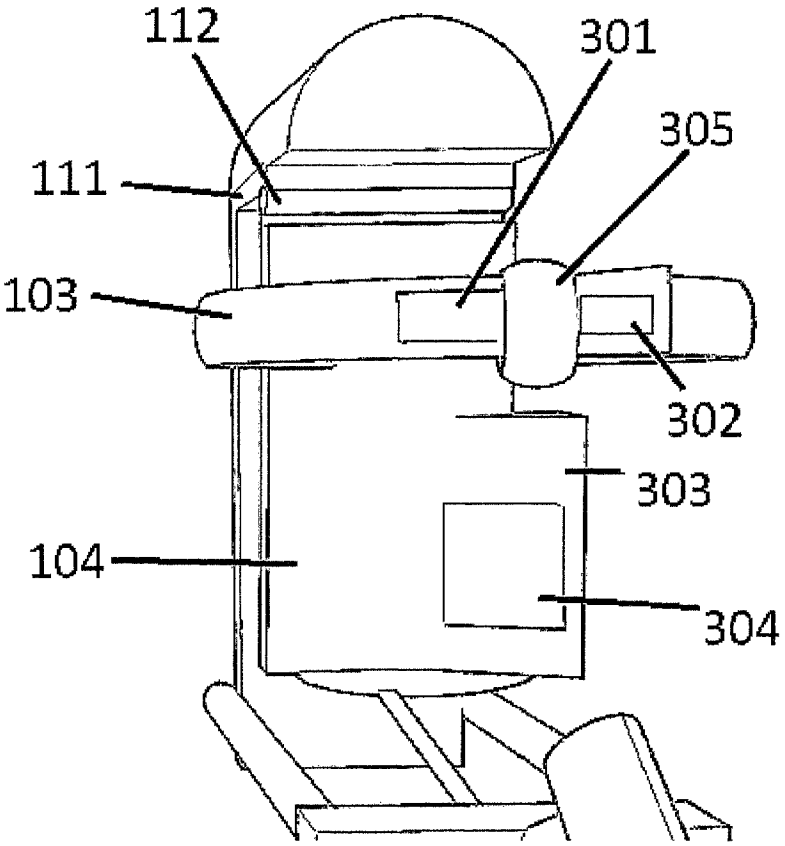
FIG. 4 is an overhead view of the drum pedal board section of FIG. 1 according to an embodiment of the present invention.

FIG. 4 is an overhead view of the drum pedal board section introduced in FIG. 1 according to an embodiment of the present invention. FIG. 4 contains various components introduced in FIG. 1 and FIG. 3 in an embodiment of the present invention. Drum pedal board 104 has an incline section 303 on the top left in this embodiment. Incline section 303 has a section of gripping surface 304 in this embodiment. Adjustable strap 103 has a fabric section of hooks 302 that goes through buckle 305 and then over the top of buckle 305 to fasten on to the fabric section of loops 301 in an embodiment of the present invention. Hinge 112 connects a drum pedal board to a vertical wall 111 in this embodiment of the present invention.

Figure 5:
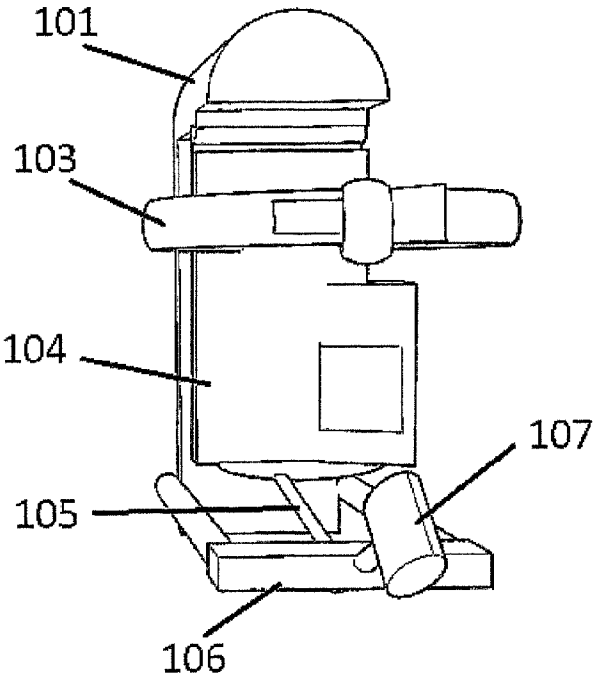
FIG. 5 is a top view of FIG. 1 according to a further embodiment of the present invention.

FIG. 5 is a top view of FIG. 1 according to a further embodiment of this present invention. FIG. 5 contains various components introduced in FIG. 1. The bottom end of an embodiment of the present invention is heel base 101. Drum pedal board 104 is in front of heel base 101 in this embodiment. Adjustable strap 103 is connected to drum pedal board 104 in this embodiment. Drum pedal board 104 is connected to the drum beater holder 106 by a chain 105 in an embodiment of this present invention. Drum beater holder 106 holds drum beater 107 in this embodiment.

FIG. 6 is a process flow chart 600 illustrating the use of the drum pedal 100 in FIG. 1. The first step 600, in one embodiment of the present invention, user places front of foot through adjustable strap 103 and then rests the heel of the foot on heel base 101 or heel plate 102. The second step 602, in one embodiment, user then places the rest of the foot on drum pedal board 104. The top, left section of the user's foot should rest on incline section 303 of drum pedal board 104. The third step 603, in one embodiment, the user pulls adjustable strap 103, that has the end with fabric strip of hooks 302, and then fastens it to fabric strip of loops 301. The fourth step 604, in one embodiment, the user then presses down on drum pedal board 104 which pulls the chain 105 which then pulls the drum beater holder 106 and the drum beater holder 106 pulls the drum beater 107 forward striking the bass drum in this embodiment. The fifth step, in one embodiment, is the user then either releases tension on the drum pedal board or continues to hold tension on the drum pedal board in an embodiment of the present invention.

The invention claimed is:

1. A raised heel drum pedal comprising: a drum pedal bottom having a first end, second end, and an intermediate portion therebetween the front end and rear end, a raised heel base having an elongated, immobile, solid base, a top surface, front end, rear end, and side ends, a heel insert with a front end, bottom end, sides, insert and crevasse, a drum pedal board having a front end, rear end, top surface and bottom surface, a drum beater attached to a drum beater holder, drum pedal columns having elongated sides, a top surface and a hole near the top surface where the drum beater holder is attached, a spring connected to the drum beater holder and a section of the drum pedal column, an adjustable strap, wherein said drum pedal having said raised heel base at rear end and said drum pedal columns at front end, the drum pedal board disposed between the raised heel base and the drum pedal columns, said drum pedal board is attached to said raised heel base by a hinge, and the hinge is attached to the front end of the raised heel base, and the hinge is attached underneath said pedal floor board at rear end, the drum pedal board is attached to the center of drum beater holder by a chain, and the chain is attached at the center and underneath the front end of the drum pedal board.

2. A raised heel drum pedal as in claim 1, wherein said heel base and said heel plate are removably secured by an insert on bottom of said heel plate fitting into a crevasse on top of said raised heel base.

3. A raised drum pedal as in claim 1, wherein said drum pedal board has a raised section located at top, left, for use with the user's right foot, or top, right, for use with the user's left foot, said raised section is at an incline of 5 degrees from right side to left side.

4. A raised heel drum pedal, wherein said drum pedal board has an adjustable strap attached to the bottom surface, the left side of the strap is around the left side of the drum pedal board and the right side of the strap is around the right side of the drum pedal board and secured above the top surface of the drum pedal board.

* * * * *